United States Patent [19]

O'Brien et al.

[11] Patent Number: 4,876,843

[45] Date of Patent: Oct. 31, 1989

[54] TAMPER INDICATOR FOR A BLISTER PACKAGE AND METHOD OF ASSEMBLY

[75] Inventors: Denise M. O'Brien, Whippany; Carlo P. Croce, Leonia, both of N.J.

[73] Assignee: Warner-Lambert Company, Morris Plains, N.J.

[21] Appl. No.: 276,581

[22] Filed: Nov. 28, 1988

Related U.S. Application Data

[62] Division of Ser. No. 134,342, Dec. 17, 1987, Pat. No. 4,838,425.

[51] Int. Cl.[4] ..... B65B 53/06; B65B 11/52; B65B 9/02

[52] U.S. Cl. ..... 53/410; 53/442; 53/449; 53/477

[58] Field of Search ..... 53/426, 442, 449, 472, 53/478, 410; 206/461, 497, 484.2, 531, 532, 807

[56] References Cited

U.S. PATENT DOCUMENTS

| | | | |
|---|---|---|---|
| 3,017,729 | 1/1962 | Cheeley | 53/442 X |
| 3,050,402 | 8/1962 | Dreyfus et al. | 53/442 X |
| 3,331,495 | 7/1967 | Leckzik et al | 206/531 |
| 3,503,493 | 3/1970 | Nagy | 53/449 X |

*Primary Examiner*—Horace M. Culver

*Attorney, Agent, or Firm*—Gary M. Nath; Charles A. Gaglia, Jr.

[57] ABSTRACT

A tamper indicator for a blister package having a rupturable lid which is attached to a base formed with recesses that hold articles in the recesses between the lid and the base. The indicator comprises an easily ruptured and tearable film that completely covers the exposed surface of the base and is attached to the lid near the juncture of the lid and the base.

2 Claims, 2 Drawing Sheets

TAMPER INDICATOR FOR A BLISTER PACKAGE AND METHOD OF ASSEMBLY

This is a divisional of copending application Ser. No. 07/134,342 filed on Dec. 17, 1987 and now U.S. Pat. No. 4,838,425.

BACKGROUND OF THE INVENTION

This invention relates generally to packaging techniques which provide for tamper resistant or tamper evident coverings. More particularly, the present invention relates to a tamper indicator film for covering at least part of a blister package in which pharmaceutical capsules, candies or other articles are held.

DISCUSSION OF THE PRIOR ART

As is well known in the packaging industry, some means for determining whether a package has been tampered with is crucial. This is particularly so in field where the packages contain pharmaceuticals, medicaments, food confectionary or anything which is likely to be ingested by humans. Attempts to solve this problem have generally focused on ways to determine when the package containing the articles has been tampered with. One type of frequently used package which is particularly susceptible to tampering is the "blister" package.

Typically, the blister package comprises a polyvinylchloride (PVC) base which has been formed with compartments in which articles can be held. The formed base is then covered with a lid which is rupturable to allow removal of the articles from the compartments. Typically, the lid itself is of a foil backed material which easily indicates any tampering activity. On the other hand, tampering with the PVC base is not so easily detected. Indeed, a knife or any other sharp object, can easily compromise the base. Articles can then be easily removed from the base, adulterated and reinserted without detection. Thus, some means is needed to prevent undetected substitution or addition of solid tablets or capsules from such a package.

Several packages for holding tablets or capsules have been proposed. Specifically, U.S. Pat. No. 3,036,700 to Krug for an invention entitled "Sterile Hypodermic Needle Assembly and Package" and U.S. Pat. No. 3,540,579 to Hellstrom for an invention entitled "Individualized Dispensing Packages" bot disclose packaging wherein an article is contained between a base member and a film member. More specifically, both the '700 patent and the '579 patent disclose packages in which the film member must be ruptured for removal of the article from the package and once ruptured, tampering becomes evident. These disclosures, however, are not concerned with detecting any rupture of the base member.

The present invention recognizes the need for a package in which tampering with either the lid (film member) or the base can be easily detected. Further, the present invention recognizes that removal of the articles from the package can be accomplished without rupturing the tamper indicating film. The present invention also recognizes the need for a blister package which will provide absolute assurance that the entire surface of the package is intact and that no tampering has been done. Additionally, the present invention recognizes the need for such a package which can be easily manufactured.

Accordingly, it is an object of the present invention to provide a tamper indicator for a blister package which presents surfaces on all outward exposures of the package which easily indicate whether the surface of the package has been tampered with or compromised. Still another object of the present invention is to provide a blister package on which such tampers are easily detectable. Still another object of the present invention is to present a tamper indicator for a blister package which is both easily manufactured and cost efficient.

SUMMARY OF THE INVENTION

A preferred embodiment of the novel tamper indicator of the present invention includes a film which is positioned against a surface of the package to be protected. More specifically, the tamper indicator film of the present invention completely covers the base surface of a package which is formed with at least one recess or cavity and overlaps the edge of a rupturable lid that is positioned on the base to hold articles within the recess. Stated differently, the tamper indicator film of the present invention is positioned over the base and attached to the lid in a manner which positions the film to cover the entire base of the package. Means such as a hot melt adhesive or heat seal coating is deposited on the periphery of the lid to provide for a connection between the film and the lid.

In an alternate embodiment of the novel tamper indicator, the film is dimensioned to allow positioning of additional articles between the base of the package and the film. Specifically, it is envisioned that additional capsule containing packages or informational brochures can be held between the package and the film.

The novel feature of this invention, as well as the invention itself, both as to its structure and its operation will be best understood from the accompanying drawings taken in conjunction with the accompanying description in which similar reference characters refer to similar parts and in which:

DESCRIPTION OF THE PREFERRED EMBODIMENTS

Figure 1:
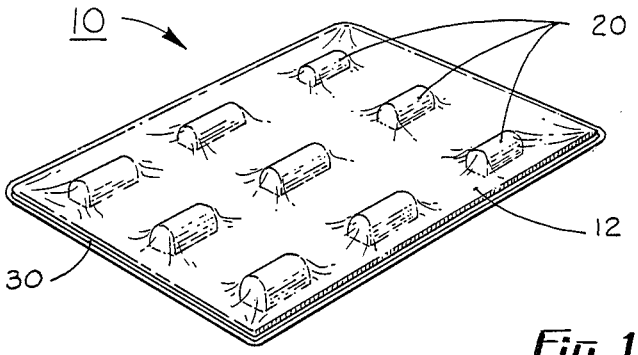
FIG. 1 is a perspective view of an assembled blister card in accordance with the present invention.

Referring initially to FIG. 1, an assembled blister card with tamper indicator is shown and generally designated 10. The actual components of blister card 10 are, however, best seen in FIG. 2 which shows that blister card 10 comprises a film 12, a base 14 and a lid 16. For the purposes of the present invention, film 12 can be made of any biaxially oriented material which will easily tear when compromised. Film 12 is preferably made of a biaxially oriented polyvinylchloride (PVC). Additionally, film 12 may be printed or colored to exaggerate the effect of tampering and thereby provide even greater ease in identifying any tampering activity.

Figure 2:
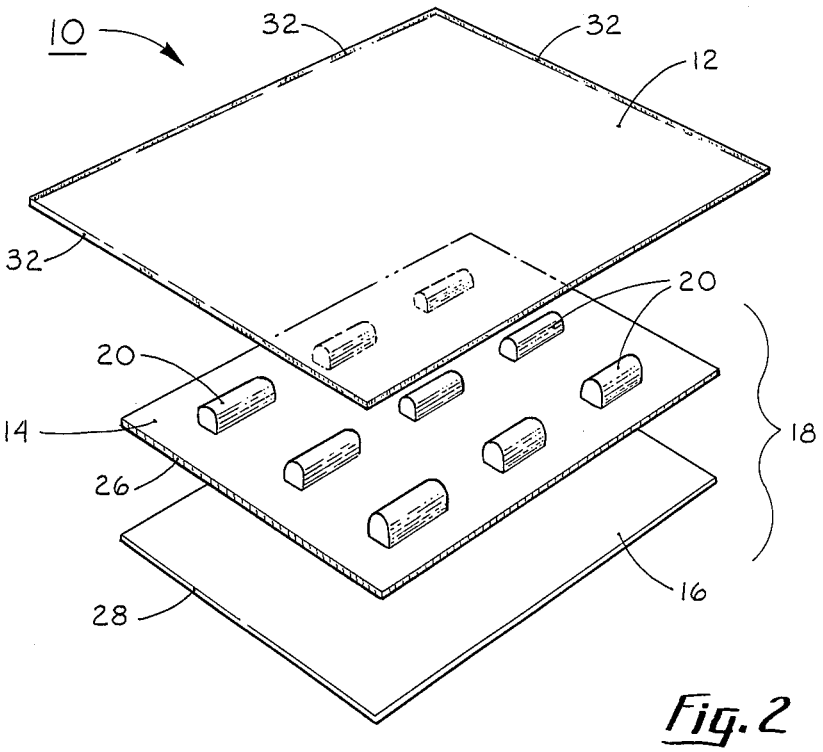
FIG. 2 is an exploded perspective view of the components of the present invention.

FIG. 2 also shows that base 14 is formed with a plurality of recesses or cavities 20 (i.e. blisters) which provide compartments into which articles can be placed. It is to be understood that recesses 20 may be formed to accommodate any particular size or shaped article that is desired. More specifically, in contemplation of the present invention, base 14 is made of a polyvinylchloride (PVC) on which recesses 20 are formed by any process well known to the skilled artisan, such as by thermoforming. According to the present invention, articles to be held in blister card 10 are deposited or placed within recesses 20 and lid 16 is then attached to base 14 in any manner well known in the pertinent art. The package 18 thus formed to hold the articles within the compartments formed by recesses 20 between the base 14 and the lid 16 is well known in the pertinent art.

Figure 3:
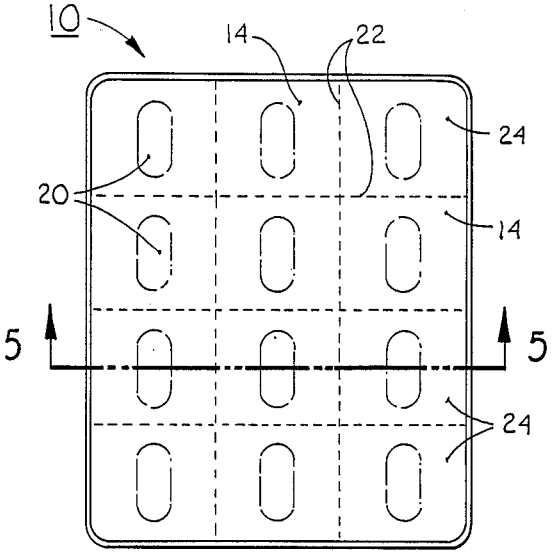
FIG. 3 is a top plan view of the blister card.
Figure 4:
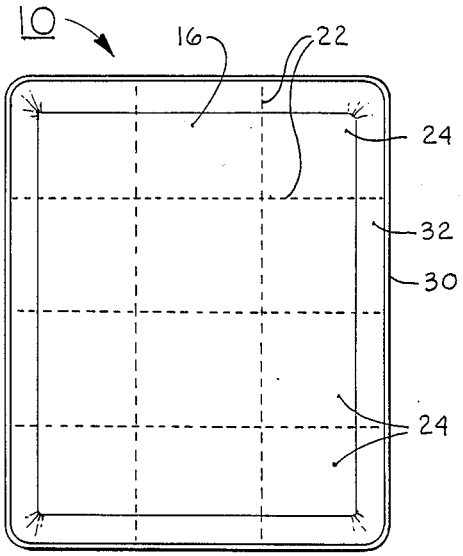
FIG. 4 is a bottom plan view of the blister card.

For purposes of the present invention, lid 16 can be made of any material well known in the art which has a push through or peelable capability. Further, as shown in FIGS. 3 and 4, base 14 can be provided with a series of perforations 22 which effectively divide base 16 into a series of separable squares 24. Thus, each article when placed within a recess 20 is associated with a square 24 which can be separated from the other articles held in their respective recesses 20 on package 18. It will be appreciated that perforations 22 need not be formed onto base 14. Indeed, in the preferred embodiment of the present invention, wherein card 10 has a single base 14, articles can be individually removed from their respective recesses 20 without separation of any individual recess 20 from other recesses 20 on card 10.

Still referring to FIG. 2, it will be appreciated that when lid 16 is joined with base 14, edge 26 to base 14 is aligned with the edge 28 of lid 16 to establish a margin 30. FIG. 2 also shows that film 12 defines a periphery 32 which is dimensioned with respect to base 14 so that film 12 covers base 14 with its periphery 32 overlapping margin 30 of package 18. When film 12 is laid onto base 14, periphery 32 of film 12 is folded over margin 30 to bring periphery 32 of film 12 into contact with lid 16 in a manner as shown in FIGS. 3 and 4. Stated differently, FIG. 4 shows that the periphery 32 has overlapped margin 30 and made contact with the lid 16 in a manner which will allow the remainder of film 12 to completely cover base 14. Film 12 is preferably made of a biaxially oriented polyvinylchloride, well known in the pertinent art, to allow for heat shrinking of the periphery 32 of film 12 to fold over margin 30 and engage with lid 16 as shown in FIG. 4. It is to be understood that the portion of periphery 32 of film 12 which is placed in contact with lid 16 may include a hot melt adhesive, a heat seal coating or any other adhesive well known in the pertinent art which will cause an adherence between periphery 32 of film 12 and lid 16. This same result can be obtained by registering a heat seal coating on that portion of lid 6 which will make contact with periphery 32.

Figure 5:
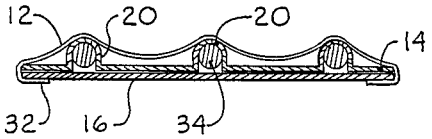
FIG. 5 is a cross sectional view of the blister card as seen along the line 5—5 in FIG. 3.

FIG. 5 shows a side cross sectional view of a blister card 10 and the interrelationship of the base 14 and lid 16 to form the recesses 20 in which articles 34 can be placed. FIG. 5 also shows periphery 32 of film 12 folded over margin 30 in a manner which causes the entire exposed surface of base 14 to be covered by the tamper indicating film 12. Further, FIG. 5 shows that access to base 14 of a blister card 10 can be accomplished only by compromising or rupturing either film 12 or lid 16. Thus, any indication of rupture on either of these components would indicate that the blister card 10 had been tampered with and that there was a possible adulteration of the articles 34 which are held within recesses 20.

Figure 6:
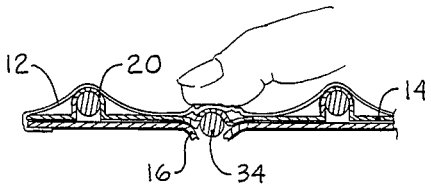
FIG. 6 is a side view of the present invention showing the manner in which an article can be removed therefrom.

FIG. 6 shows that the article 34 may be removed from blister card 10, without removal of the film 12, simply by pressing against the recess 20 in which article 34 is held to rupture the lid 16. It is understood that this action allows removal of the article 34 from blister card 10 and does not necessarily cause a rupture of film 12.

Figure 7:
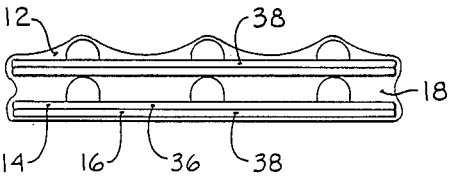
FIG. 7 is a side view of an alternate embodiment of the present invention.
Figure 8:
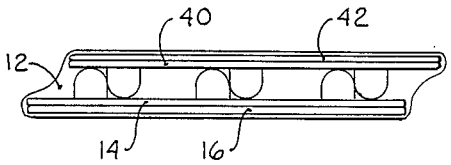
FIG. 8 is a side view of still another alternate embodiment of the present invention.

FIGS. 7 and 8 respectively show alternate embodiments of the configuration for which the tamper indicator of the present invention can be used. More specifically, FIG. 7 shows two packages 18 which are placed one on top of the other with a film 12 then placed around both packages 18. As shown in FIG. 7, this establishes a package having a base 36 and a lid 38 with lid 38 placed against base 14 to establish a blister card. In the embodiment shown in FIG. 8, a second package having a base 40 and a lid 42 is placed with base 40 touching base 14 of the other package in a manner which allows film 12 to be placed around the package substantially as shown.

It is to be understood that for all embodiments of the present invention additional objects and other materials such as advertising and promotional brochures and informational literature, or even another card 10, may be placed between film 12 and base 14 for the convenience and information of the user.

OPERATION

In its operation, blister card 10 of the present invention is provided with articles 34 placed in respectively shaped recesses 20 of a base 14. Lid 16 is then placed against base 14 and attached thereto by any means well known in the art such that articles 34 are held in recesses 20 between base 14 and lid 16. A film 12 is then placed over base 14 with the periphery 32 of film 12 extending past margin 30 which was formed at the interface between base 14 and lid 16. In accordance with well known procedures, periphery 32 of film 12 is folded over the margin 30 and attached to base 14.

Removal of articles 34 from recesses 20 is accomplished by pushing through frangible film 12 against recess 20 to cause a rupture of lid 16. The rupture of lid 16 will then allow removal of article 34 from recess 20.

While the particular tamper indicator herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

I claim:

1. A method for affixing a tamper indicator film to a package having a base formed with a recess and a rupturable lid positioned thereon to define a margin therebetween and hold articles within the recess comprising the steps of:

(a) Registering a heat seal coating on said lid near said margin;

(b) Dimensioning said film to cover said base with the periphery of said film having suitable overlap to extend beyond said margin;

(c) Placing said film against said base; and (d) Heating the periphery of said film to shrink and fold the periphery of said film over said margin to bring said overlap periphery into contact with said coating on said lid.

2. A method for affixing a tamper indicator film of biaxially oriented polyvinylchloride to a package having a base formed with a recess and a rupturable lid positioned thereon to define a margin therebetween and hold articles within the recess comprising the steps of:

(a) Applying a hot melt adhesive on said lid near said margin;

(b) Dimensioning said film to cover said base with the periphery of said film having suitable overlap to extend beyond said margin;

(c) Placing said film against said base; and (d) Heating the periphery of said film to shrink and fold the periphery of said film over said margin to bring said overlap periphery into contact with said coating on said lid, and to cause an adherence between said overlap periphery and said lid.

* * * * *